US006173462B1

(12) United States Patent
Huang et al.

(10) Patent No.: US 6,173,462 B1
(45) Date of Patent: Jan. 16, 2001

(54) CARE PAD STRUCTURE OF A SURROUNDING BABY COT

(75) Inventors: Pao-Shan Huang, Tai Pao; Er-Jui Chen, Feng-Shan, both of (TW)

(73) Assignee: Link Treasure Limited (VG)

( * ) Notice: Under 35 U.S.C. 154(b), the term of this patent shall be extended for 0 days.

(21) Appl. No.: 09/360,846

(22) Filed: Jul. 24, 1999

(30) Foreign Application Priority Data

Aug. 31, 1998 (TW) ..... 87214309

(51) Int. Cl.[7] ..... A47D 15/00; A47D 13/06
(52) U.S. Cl. ..... 5/655; 5/93.1; 5/507.1
(58) Field of Search ..... 5/93.1, 93.2, 97, 5/98.1, 99.1, 503.1, 504.1, 507.1, 658, 655

(56) References Cited

U.S. PATENT DOCUMENTS 2,536,731 * 1/1951 Douglas ..... 5/507.1 X
2,553,087 * 5/1951 Hanson ..... 5/93.1
3,644,947 * 2/1972 Padera ..... 5/93.1 X
5,349,709 * 9/1994 Cheng ..... 5/93.1
5,555,577 * 9/1996 Volpe ..... 5/93.1
5,615,427 * 4/1997 Huang ..... 5/99.1
5,778,465 * 7/1998 Myers ..... 5/99.1
5,918,329 * 7/1999 Huang ..... 5/93.1
6,058,528 * 5/2000 Yang ..... 5/93.1

* cited by examiner

*Primary Examiner*—Lynne H. Browne
*Assistant Examiner*—Robert G. Santos
(74) *Attorney, Agent, or Firm*—W. Wayne Liauh

(57) ABSTRACT

The present invention relates to A care pad structure of a surrounding baby cot. The care pad structure is composed of front frame rod and rear frame rod. The front frame rod has a positioning element connected thereon by a clipping hole for clipping on the upper frame rod of the surrounding baby cot. The rear frame rod has a connecting element and forms a hole on rear side provided for fitting on the side rod of upper frame rod. In this structure, the care pad frame rod can be raised to firmly lie on the upper frame rod of the surrounding baby cot and parks on side wall when not in use for convenience of storage. In addition, a bag can be attached on to its back side when it is parking on side wall of the surrounding baby cot to be as a storage bag of toys or something.

8 Claims, 10 Drawing Sheets

FIG.6
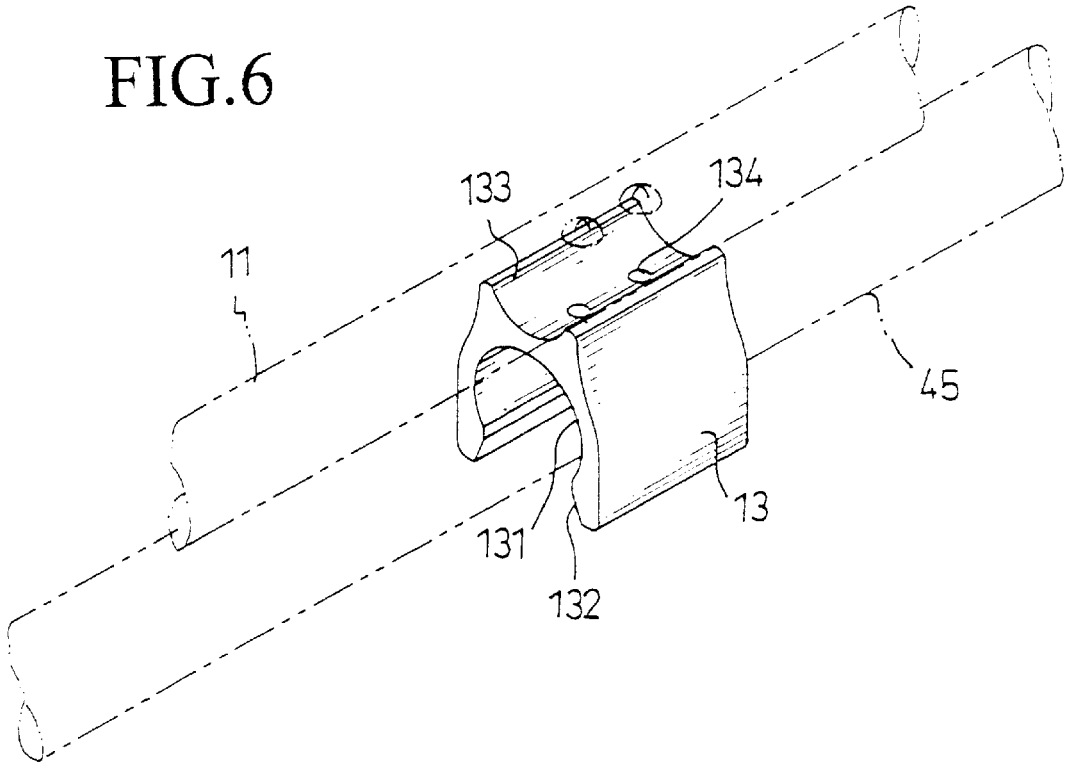
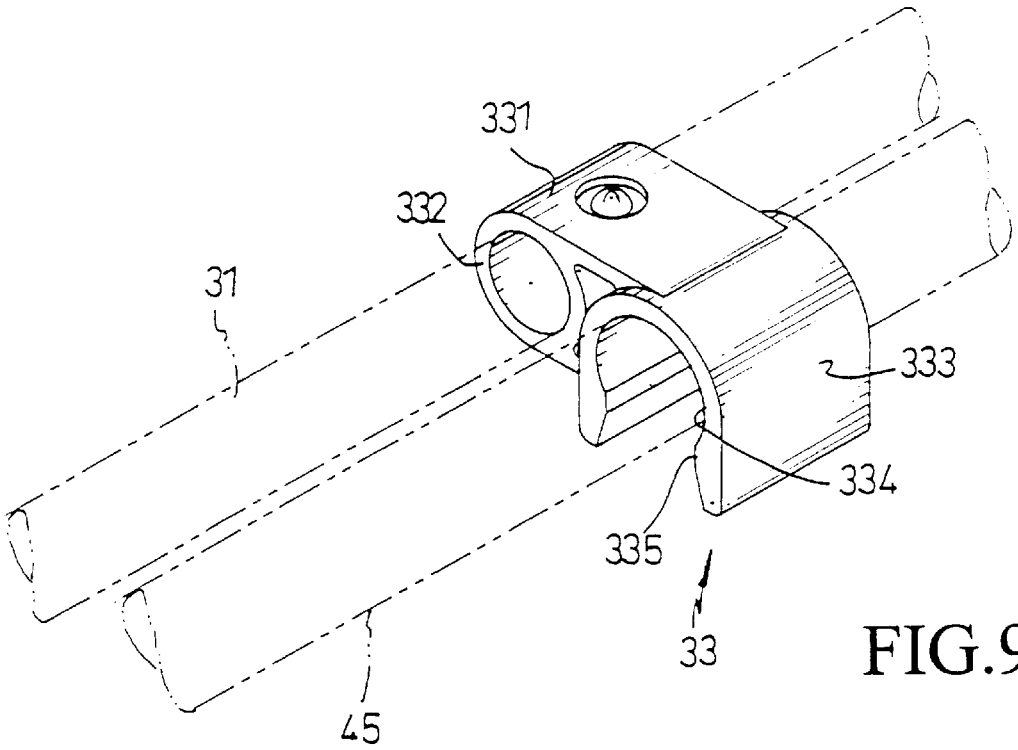
FIG.9

CARE PAD STRUCTURE OF A SURROUNDING BABY COT

FIELD OF THE INVENTION

The present invention relates to A care pad structure of a surrounding baby cot, especially for a surrounding cot which is connected on the upper location thereof and on which an infant can be put to easily proceed replacement of diaper of the baby.

BACKGROUND OF THE INVENTION

A baby is usually put into a surrounding baby cot which forms a restricted area in which it can move about. This will benefit the caregiver and prevent the baby from injuring during doing its activities inside the surrounding baby cot. This kind of the surrounding baby cot is constructed by four rods to form its base, extending upward four side rods connected to the foregoing rods, connecting another four rods to form its upper frame also connected to the foregoing side rods and attaching flat board inside the base frame and canvas on sides frames. Under this construction, a baby can be put into the restricted area for easier care.

Though this surrounding baby cot provides a safer and easier care situation, the side walls which are designed so high enough to prevent the baby from crossing or climbing over are obstacles for the caregiver to proceed replacement of diaper of the baby. The surrounding walls are so high that the caregiver must stoop down to proceed many activities of baby, for example, replacement of diaper of the baby. It is really a narrow place for an adult to doing activities inside the surrounding walls of the baby cot, especially for an adult to proceed replacement of diaper of a baby. This needs to be modified.

According to forgoing description about the conventional surrounding baby cot, the present invention provides, after repeatedly experiment testing, a novel care pad structure for a surrounding baby cot. The object of the present invention is to provide A care pad structure of a surrounding baby cot.

SUMMARY OF THE INVENTION

Accordingly, the present invention provides mainly A care pad structure of a surrounding baby cot, wherein the care pad structure is composed of front frame rod and rear frame rod. The front frame rod has a positioning element connected thereon by a clipping hole for clipping on the upper frame rod of the surrounding baby cot. The rear frame rod has a connecting element which has a hole near front edge provided for being fitted in, forms a fixing seat provided for fixing of inserting end formed at both ends of the sync-positioning rod and forms a hole on rear side provided for fitting on the side rod of upper frame rod. In this structure, the care pad frame rod can be raised to firmly lie on the upper frame rod of the surrounding baby cot by clipping the positioning element on the upper frame rod thereof and parks on side wall when not in use for convenience of storage. In addition, a bag can be attached on to its back side when it is parking on side wall of the surrounding baby cot to be as a storage bag of toys or something.

These and other features of the present invention will become more fully apparent from the following description and dependent claims taken in conjunction with the accompanying drawings.

BRIEF DESCRIPTION OF THE DRAWINGS

The present invention is illustrated by the following drawings in which:

FIG. 6 is a perspective view of the positioning element of the present invention, depicting the practicing status.

FIG. 9 is a perspective view of second positioning element of the present invention, depicting the practicing status.

DETAILED DESCRIPTION OF THE PREFERRED EMBODIMENT

Figure 1:
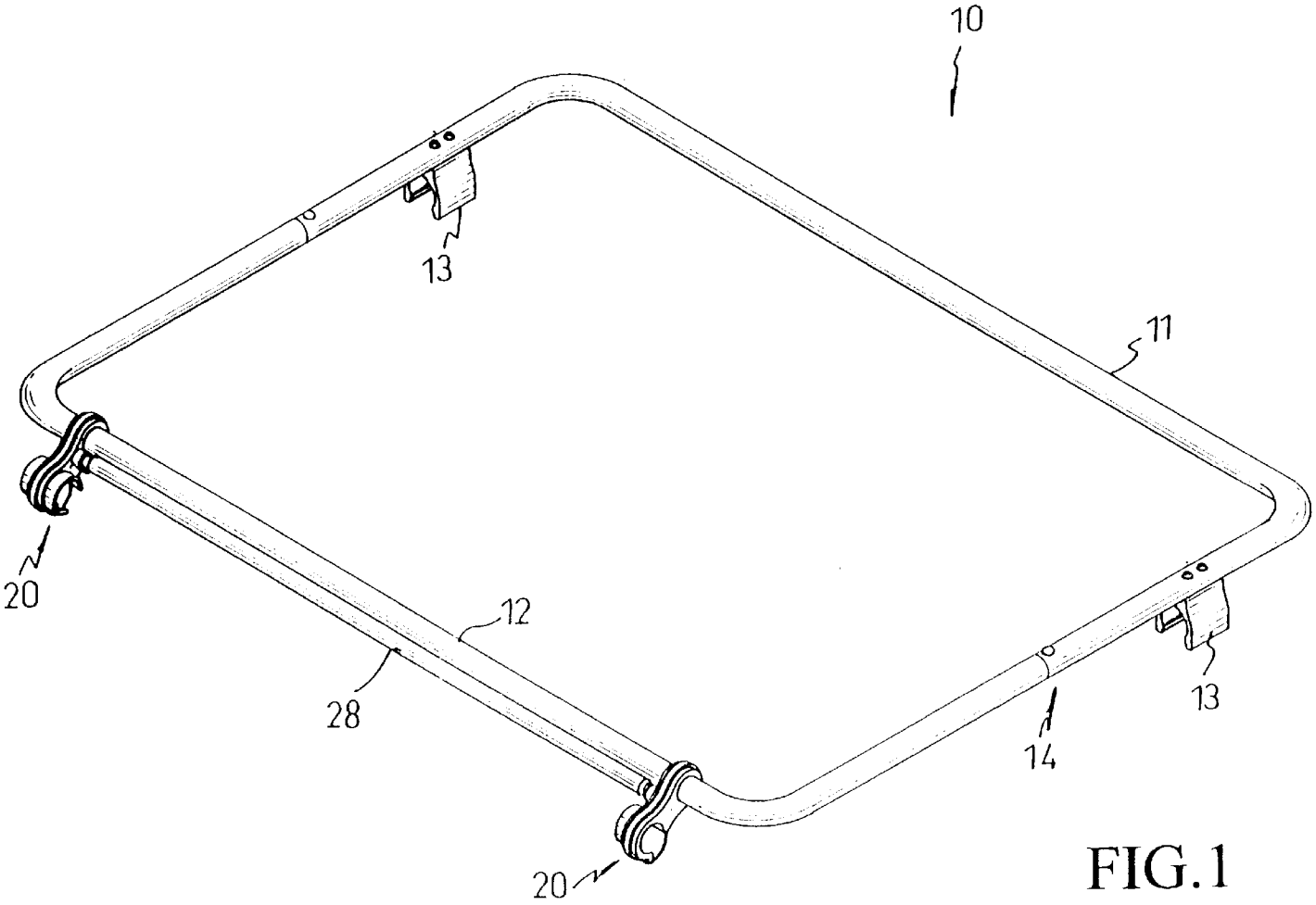
FIG. 1 is a perspective view of the present invention, A care pad structure of a surrounding baby cot.
Figure 2:
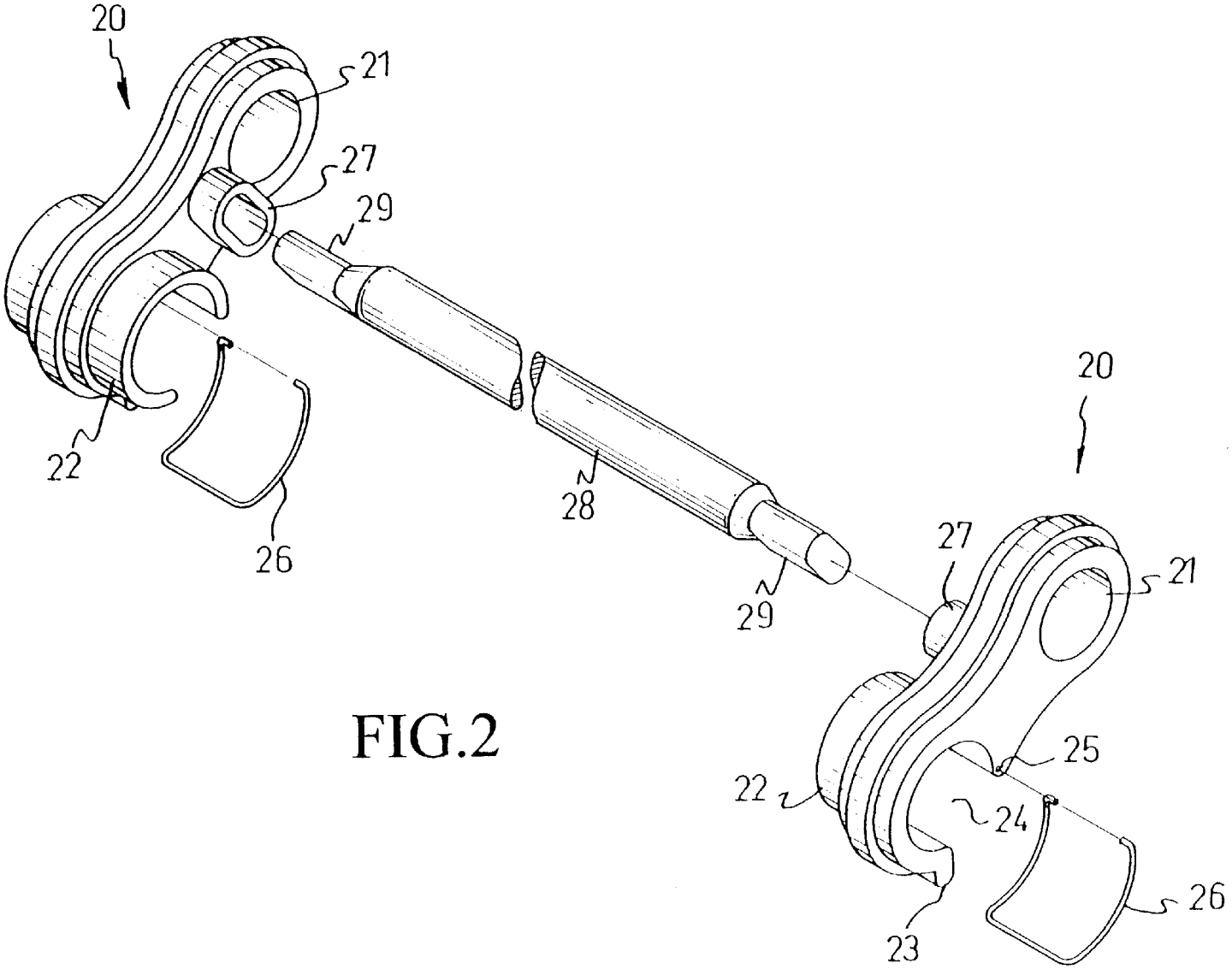
FIG. 2 is a exploded perspective view of the connecting portion of the present invention.

Firstly, referring to FIG. 1 and FIG. 2, which are the perspective view of the present invention, a care pad structure 10 for a surrounding baby cot and the exploded perspective view of the connecting portion, connecting element 20 and sync-positioning rod 28, of the present invention. The care pad structure 10 comprises front frame rod 11, rear frame rod 12, positioning element 13 and connecting element 20. The connecting element 20 has a hole 21 at its front edge provided for the rear frame rod 12 to pass through and has a fixing seat 27 connected at its side end and provided for the inserting end 29 formed at both sides of the sync-positioning rod 28 to be firmly fitted into. Furthermore, the connecting element 20 has a clip seat 22 at its backside which forms a hole 24 with an opening, a raised end 23 on its front edge, holes 25 on both sides of its root portion and arc-shaped buckling piece 26 with bending portion on both ends thereof provided for inserting into the holes 25.

Figure 3:
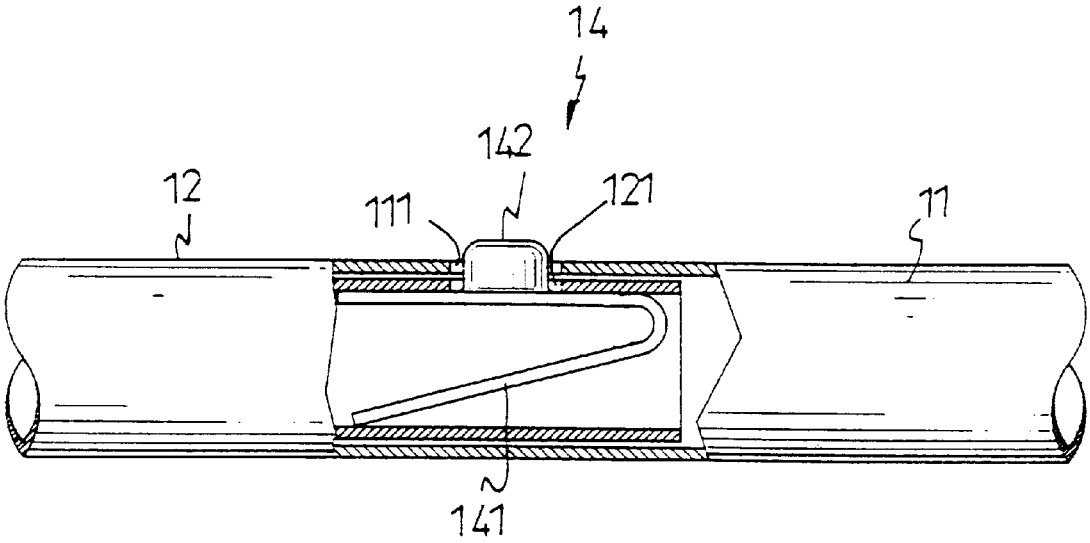
FIG. 3 is a cut view of the connecting portion of the frame rod of the present invention.

The front frame rod 11 and rear frame rod 12 of the care pad structure 10 can be connected by the connecting portion 14, as shown in FIG. 3. The end edge area of the "U" shaped front frame rod 11 has a hole 111. The front edge of the rear frame rod 12 also has a hole 121. The front edge of the rear frame rod 12 can be inserted into the front frame rod 11, and the raised portion 142 of the buckling spring 141 located inside the rear frame rod 12 can pass through hole 121 and hole 111 separately.

Figure 4:
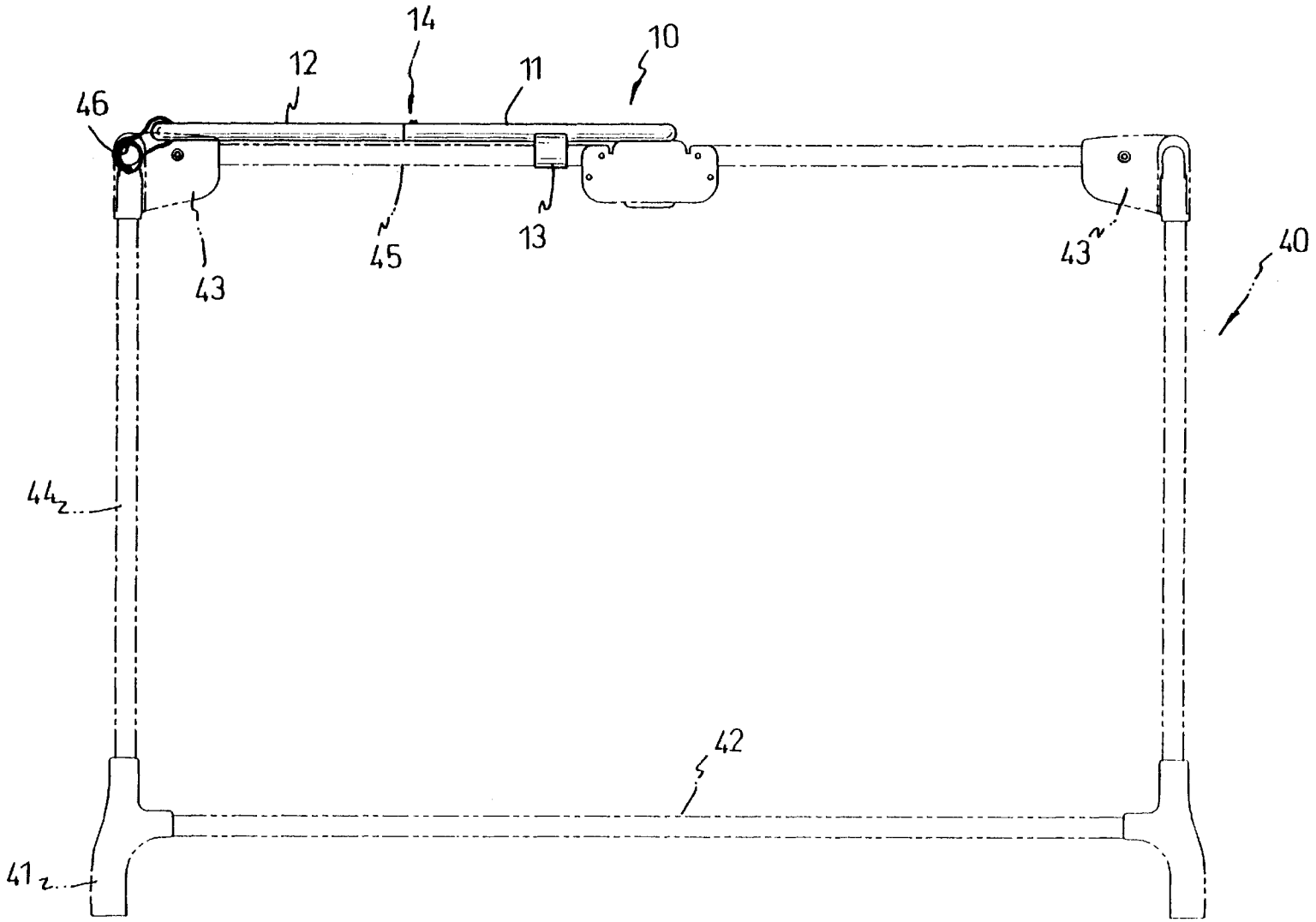
FIG. 4 is a side view of the present invention which lies on the upper frame rod of a surrounding baby cot.
Figure 5:
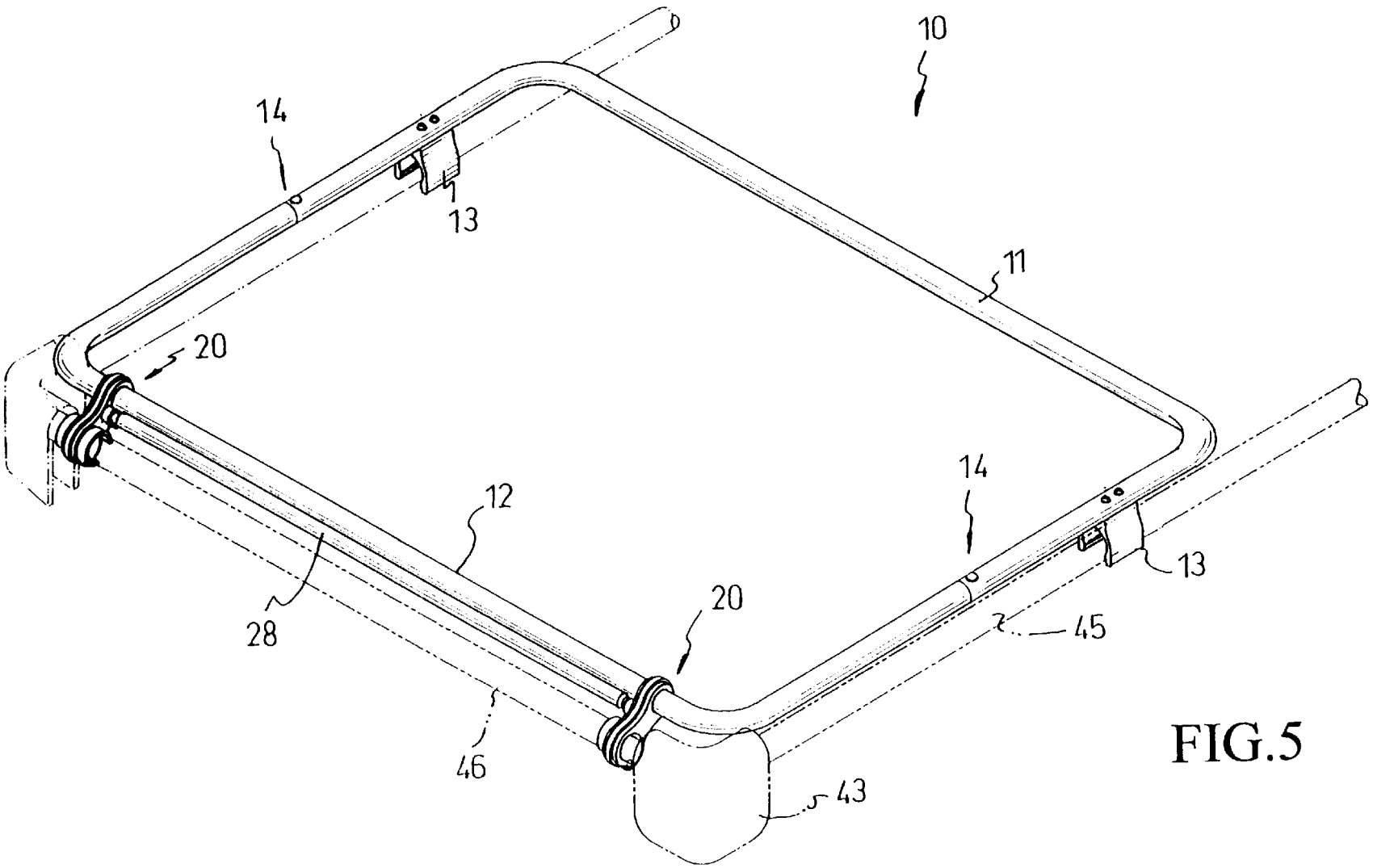
FIG. 5 is a perspective view of the present invention which lies on the upper frame of a surrounding baby cot.

Referring to FIG. 4 and FIG. 5, the care pad structure 10 can be located on the upper side of the surrounding baby cot 40. The surrounding baby cot 40 has four legs 41 connected under the base frame rod 42 and four side frame rods 44 connected upward on the base frame rod 42. Canvas is constructed between four base frame rods 42 and every two neighboring side frame rods 44. In addition, a flat board is put on the base frame and covered by canvas. The connecting seat 43 further connects the upper end of the side frame rod 44 and the end portion of the upper frame rod 45 and connects the upper end of the side frame rod 44 and the end portion of the side upper frame rod 46. The hole 24 formed beneath the clip seat 22 of the connecting element 20 clips on the side upper frame rod 46 of the surrounding baby cot 40. Under this condition, buckling piece 26 can be fitted to the raised end 23 of the front end of the clip seat 22 for a complete connection.

Referring to FIG. 5, again, and FIG. 6, the positioning element 13 is adequately located on the front frame rod 11. The positioning element 13 forms an arc trough 133 on its top, wherein the arc trough 133 has the hole 134 provided for firmly connecting the positioning element 13 to the front frame rod 11 by passing a screw through the hole 134 and the hole on the front frame rod 11 and is designed to contact the surface of the front frame rod 11. The positioning element 13 also forms a hole 131 inside which has a raised portion 132 in its inner edge and can be fitted on the upper frame rod 45 for firmly connecting by pushing the upper frame rod 45 passing through the raised portion 132 to the hole 131. Canvas can be put inside the care pad structure 10 formed by front frame rod 11 and rear frame rod 12, and a baby can be moved to lie on this area and proceed replacement of diaper of baby in a more convenient way.

Figure 7:
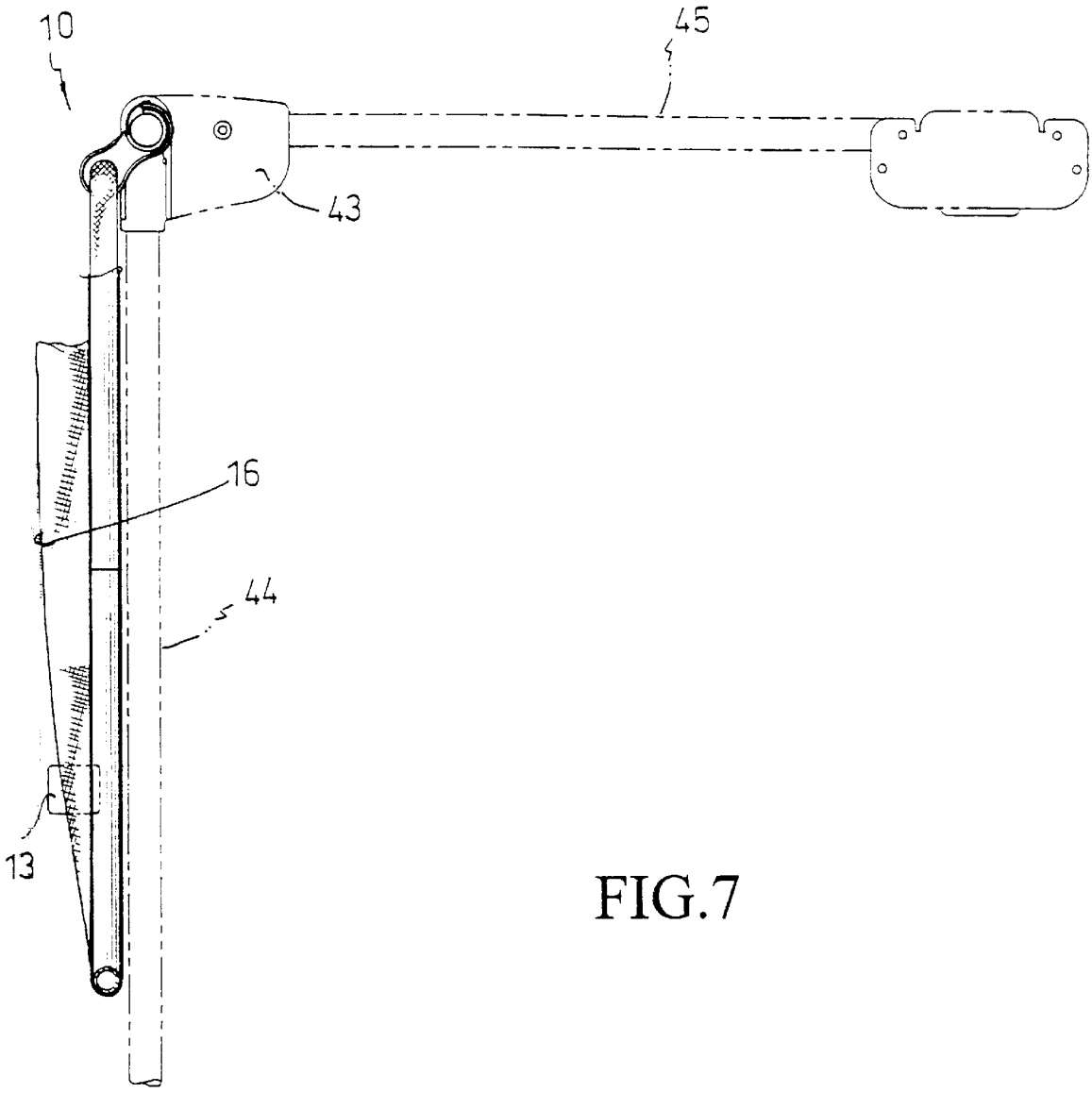
FIG. 7 is a side view of the present invention which hangs on the side frame rod of a surrounding baby cot.

After using the care pad structure 10, it can be turned around to the side wall of the surrounding baby cot 40 by taking off the positioning element 13 from upper frame rod 45, as shown in FIG. 7. Besides, a bag 16 can be attached on the backside of the canvas 15 of the care pad structure 10. The bag 16 will show up when the care pad structure 10 is turned around to the side wall of the surrounding baby cot 40 and be a storage bag of toys or something else of the baby.

Figure 8:
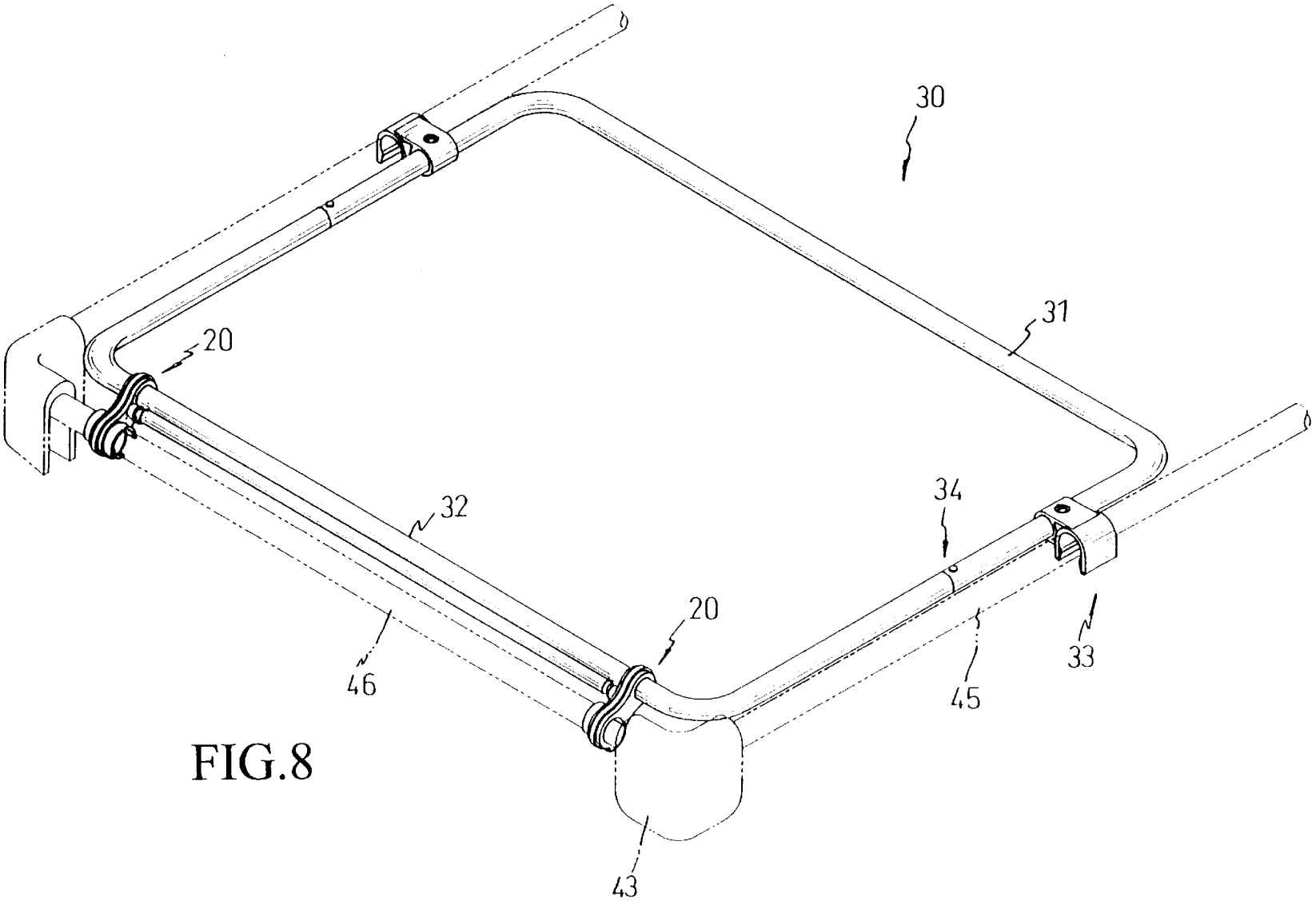
FIG. 8 is a perspective view of another embodiment of the present invention, A care pad structure of a surrounding baby cot.

Referring now to FIG. 8 and FIG. 9, they show another embodiment of the frame 30 of the present invention. The same, it includes front frame rod 31 and rear frame rod 32, wherein the rear frame rod 32 has the same connecting element 20 as foregoing for fitting on the side upper frame rod 46. In this embodiment, the connecting element 33 is wider, which forms a fixing seat 331 and a holding seat 333. The fixing seat 331 has a hole 332 provided for being passing through by the front frame rod 31. The holding seat 333 has an opening hole 334 which has a raised portion 335 in its inner side edge provided for fixing the care pad structure 30 on the surrounding baby cot in further use by fitting on the upper frame rod 45 and pushing the upper frame rod 45 into the raised portion 335.

Figure 10:
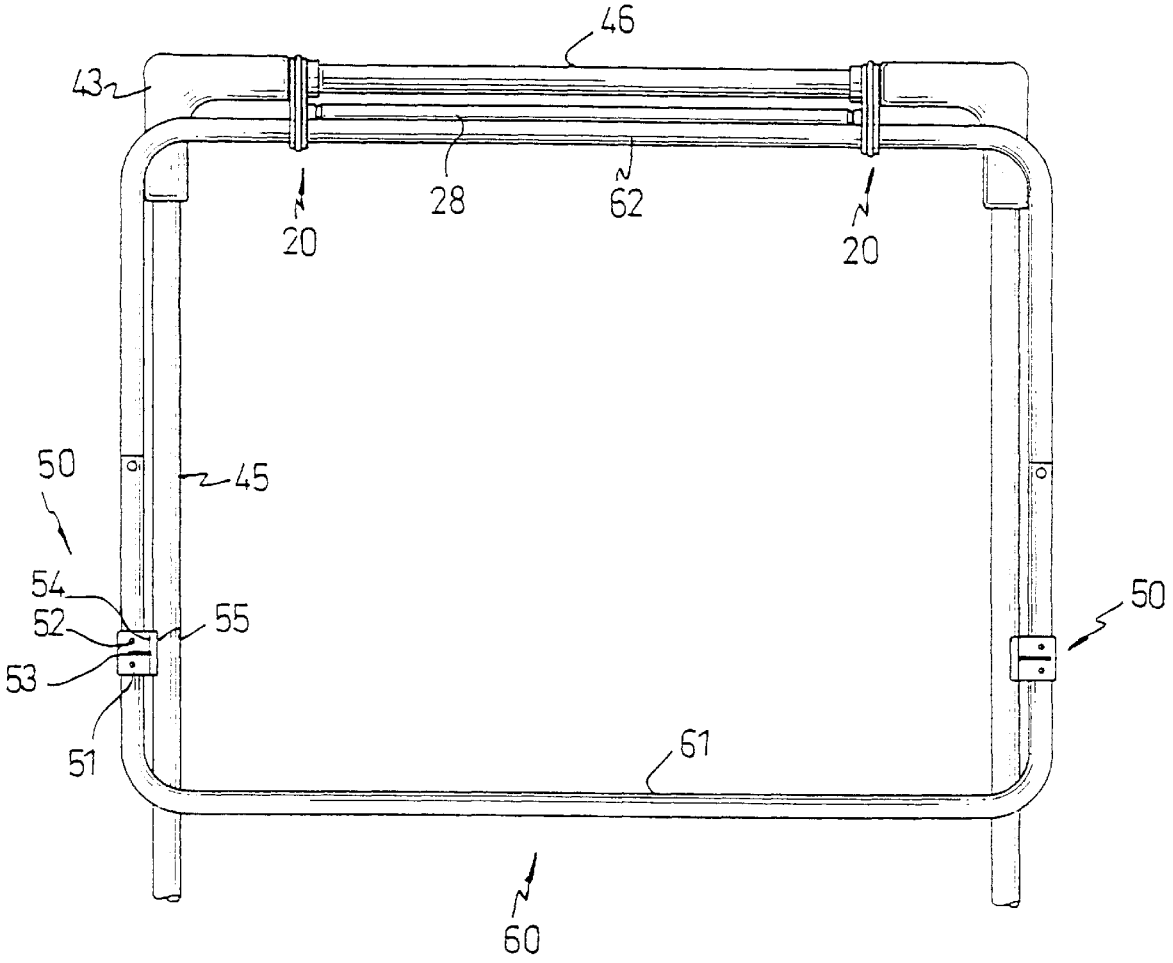
FIG. 10 is a upper view of third positioning element of the present invention, depicting the practicing status.
Figure 11:
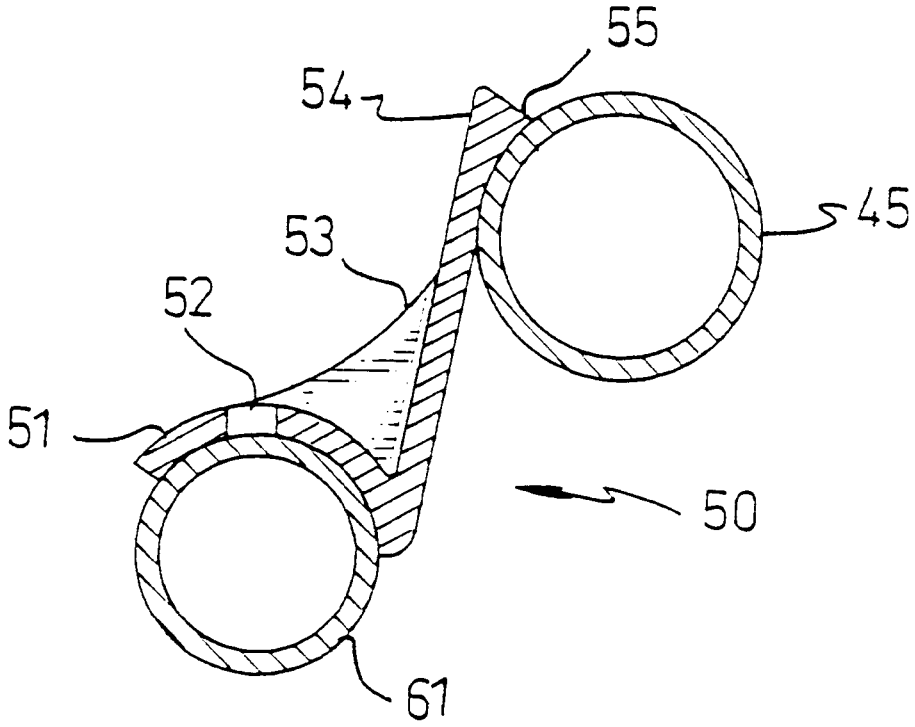
FIG. 11 is a cut view of fourth positioning element of the present invention.

Referring now to FIG. 10 and FIG. 11, they show another two, the third and the fourth, embodiments of the positioning element 50 of the present invention. The care pad structure 60 is, the same, composed of front frame rod 61 and rear frame rod 62 and is, the same, connected to the side upper frame rod 46 with the rear frame rod 62 thereof by the connecting element 20. But in this embodiment, the frame formed by those can be wider than the width between two upper frames 45. The arc portion 51 of the positioning element 50 locating on the front frame rod 61 can clip on the front frame rod 61, has the hole 52 for firmly connecting by screw and has a clip portion 54 on one side. The clip portion 54 forms a raised portion 55 on its outer side of upper end. In the connecting area between arc portion 51 and clip portion 54, there can form a rib 53 for stronger supporting. When the care pad structure 60 contacts the upper frame rod 45, the clip portion 54 of the positioning element 50 can tightly contact the side of the upper frame rod 45 and the raised portion 55 can tightly contact the outer surface of the upper frame rod 45. This can firmly fix the care pad structure 60 on the surrounding baby cot for further use.

Numerous variations and modifications will suggest themselves to persons skilled in the arts, other than those already described, without departing the basic inventive concepts. Although the present invention has been described with respect to typical preferred embodiments thereof, it should be understood that the present inventions is not limited to these embodiments, and various changes or modifications may be made without departing from the scope of the present invention as defined by the appended claims.

EFFECTS OF THE INVENTION

The present invention provides mainly A care pad structure of a surrounding baby cot to prevent the caregiver from stooping down to proceed many activities of baby, for example, replacement of diaper of the baby.

The present invention provides a novel care pad structure for a surrounding baby cot, which can be firmly fixed when using and can be folded when not in use without occupying additional space.

The present invention provides a novel care pad structure for a surrounding baby cot, which is also multi-functional by providing a storage bag for users.

What is claimed is:

1. A care pad structure of a surrounding baby cot, which includes an upper frame having a upper frame rod and a side upper frame rod neighboring to said upper frame rod thereof, said care pad comprising:

a rectangular frame constructed by a frame rod for forming an outer frame of a care area, a connecting element connected to said frame rod of said rectangular frame as a pivoting and supporting means thereof, and a care pad constructed inside said rectangular frame, which forms said care area, wherein said connecting element has a hole provided for said frame rod to pass therethrough, a fixing seat formed at a side wall for a sync-positioning rod having an inserting end at both ends to fit in, and a clip seat having an opening hole.

2. A care pad structure of a surrounding baby cot as described in claim 1, wherein said frame rod is composed of a front frame rod which connects a positioning element thereon having an opening hole provided for clipping on an upper frame rod and a rear frame rod joined to said front frame rod.

3. A care pad structure of a surrounding baby cot as described in claim 2, wherein said positioning element includes a arc trough in the upper side provided for contacting said front frame rod and a hole located at said arc trough for connecting to said front frame rod by passing through a screw.

4. A care pad structure of a surrounding baby cot as described in claim 2, wherein said positioning element further includes a fixing seat which locates in parallel to said opening hole and has a hole located at said fixing seat for connecting to said front frame rod by passing through a screw.

5. A care pad structure of a surrounding baby cot as described in claim 2 or 4, wherein said opining hole of said position element further comprises a raised portion on an inner surface thereof.

6. A care pad structure of a surrounding baby cot as described in claim 1, wherein said care pad farther comprises a storage bag located on the backside of said care pad.

7. A care pad structure of a surrounding baby cot, which includes an upper frame having a upper frame rod and a side upper frame rod neighboring to said upper frame rod thereof, said care pad comprising:

a rectangular frame constructed by a frame rod for forming an outer frame of a care area, a connecting element connected said frame rod of said rectangular frame as a pivoting and supporting means thereof, and a care pad constructed inside said rectangular frame, which forms said care area, wherein said connecting element further comprises a clip seat having an opening hole, a buckling hole located on the end portion of said clip seat and an arc-shaped buckling piece fitted into said buckling hole and provided for increasing holding ability.

8. A care pad structure of a surrounding baby cot, which includes an upper frame having a upper frame rod and a side upper frame rod neighboring to said upper frame rod thereof, said care pad comprising:

a rectangular frame constructed by a frame rod for forming an outer frame of a care area, a connecting element connected said frame rod of said rectangular frame as a pivoting and supporting means thereof, and a care pad constructed inside said rectangular frame, which forms said care area, wherein said frame rod comprises a front frame rod which connects a said positioning element, and said positioning element comprises an arc portion having a hole, a clip portion connected to said arc portion, a raised portion located on an end of said clip portion, and a rib formed between said arc portion and said clip portion to increase strength.

* * * * *